United States Patent [19]

Mancini et al.

[11] 4,007,901

[45] Feb. 15, 1977

[54] CHRISTMAS TREE STAND

[76] Inventors: Angelo J. Mancini; Ronald W. Galloway, both of Box 517, Afton, Wyo. 83110

[22] Filed: Nov. 20, 1975

[21] Appl. No.: 633,678

[52] U.S. Cl. ..... 248/526

[51] Int. Cl.[2] ..... A01K 97/10

[58] Field of Search ..... 248/44, 47, 188.3, 188.7, 248/519, 523, 525, 526

[56] References Cited

UNITED STATES PATENTS

| | | | |
|---|---|---|---|
| 694,867 | 3/1902 | Krick | 248/47 |
| 1,334,880 | 3/1920 | Auslander | 248/47 |
| 1,644,807 | 10/1927 | Zeigler | 248/47 |
| 1,876,276 | 9/1932 | Danner | 248/526 |
| 3,473,771 | 10/1969 | Newman | 248/47 |
| 3,815,854 | 6/1974 | Zipser | 248/47 |

FOREIGN PATENTS OR APPLICATIONS

| | | | |
|---|---|---|---|
| 434,869 | 3/1948 | Italy | 248/47 |

*Primary Examiner*—Robert A. Hafer
*Attorney, Agent, or Firm*—B. Deon Criddle

[57] ABSTRACT

A low cost, easily installed, support base for Christmas trees and the like including a water retaining base support vessel, and an angulated base on which the base support vessel rests and to which support members are pivotally attached. Each support member includes a leg, an upwardly and inwardly extending arm, and a partial collar attached to the end of the arm and adapted to engage a tree trunk. The relationship of the arm to the leg of each support member is such that the support stand will present a low silhouette and slim profile during use and will largely be hidden by the limbs of a tree supported by the stand.

1 Claim, 3 Drawing Figures

CHRISTMAS TREE STAND

BRIEF DESCRIPTION OF THE INVENTION

Field of the Invention

This invention relates to support stands of the type that are commonly used to temporarily support Christmas trees and the like.

Prior Art

There have been a great many Christmas tree support stands developed in the past. Many of these previously known stands have included an arrangement whereby a portion of a pivoting support leg will engage a tree trunk to assist in stabilizing the tree supported by the stand. These prior art patents, while incorporating many of the features of the present invention, do not provide for a low silhouette and a slim profile such as to make them quite unobtrusive when used in the supporting of a Christmas tree.

Summary of the Invention

Principal objects of the present invention are to provide a Christmas tree stand that will fit on the bottom of a Christmas tree, or the like, that does not require careful fitting in the installation thereof, that will securely grip and hold the tree, that will adapt to fit trees having trunks of different sizes, and that will, when installed, present a slim profile and a low silhouette radiating outwardly from the tree trunk.

Other objects are to provide such a Christmas tree stand that can be very economically produced, that is easily used, and that will support water to help maintain the supported tree in a fresh condition for a maximum period of time.

Principal features of the invention include a generally Y-shaped base having a upturned base vessel mounted on an upper surface thereof and with the extensions of the base projecting slightly beyond the side wall of the base vessel. A support member is pivotally connected to each extension outside of the wall of the base vessel and each support member includes an outwardly extending leg portion and an upwardly and inwardly extending arm portion. The leg portion and arm portion are necessarily formed integral and the support member is pivotally connected to the extension at the intersection of the leg and arm portions of the support member. It has been found that the interior angle formed between the leg portion and the arm portion must be within the range of a 102°–106° with the optimum angle being a 104°. A partial collar is fixed to the inturned end of each arm and extends transversely to the arm. The partial collars of the support members, thus cooperatively partially encircle and better hold a tree in position in the support stand.

Additional objects and features will become apparent to those skilled in the art from the following detailed description and claims, taken together with the accompanying drawings.

THE DRAWINGS

In the drawings:

FIG. 1 is a side elevation view, showing a tree mounted in a support stand of the invention.

FIG. 2, a perspective view, taken from slightly above the support stand of the invention, and with the pivoted support members shown pivoted open to allow a tree trunk to be inserted in the base vessel; and FIG. 3, an enlarged side elevation view of the support stand, partially cut-away to show the interior thereof and with a tree trunk shown in phantom lines.

DETAILED DESCRIPTION

Figure 1:
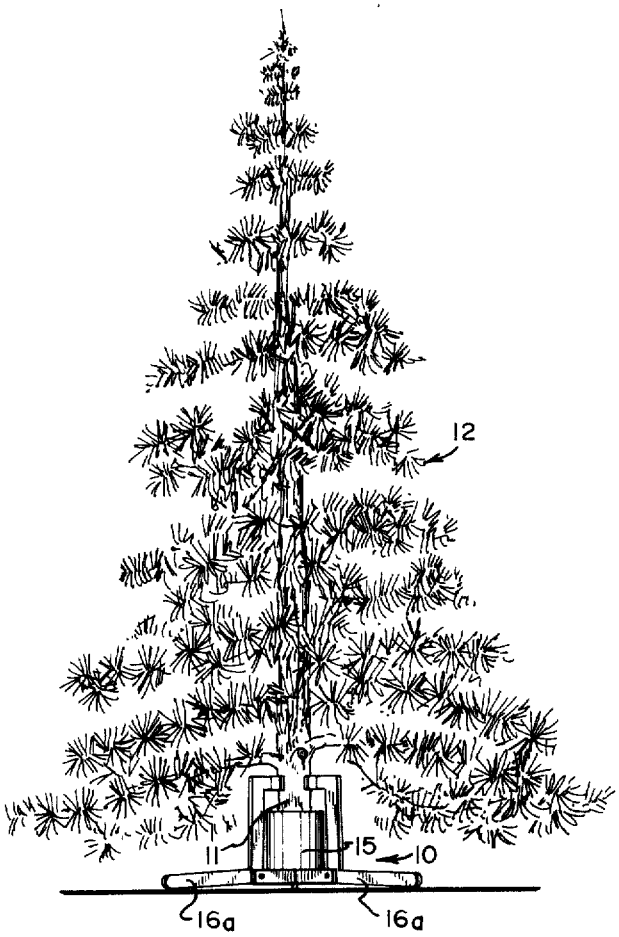

Referring now to the drawings:

In the illustrative preferred embodiment, the support stand, shown generally at 10 is adapted to receive the trunk 11 of a tree shown at 12.

Figure 2:
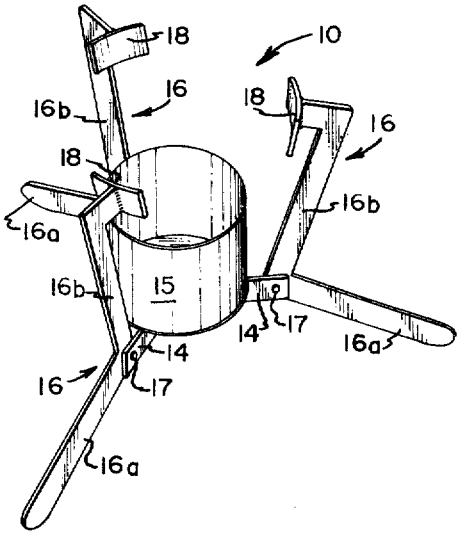
Figure 3:
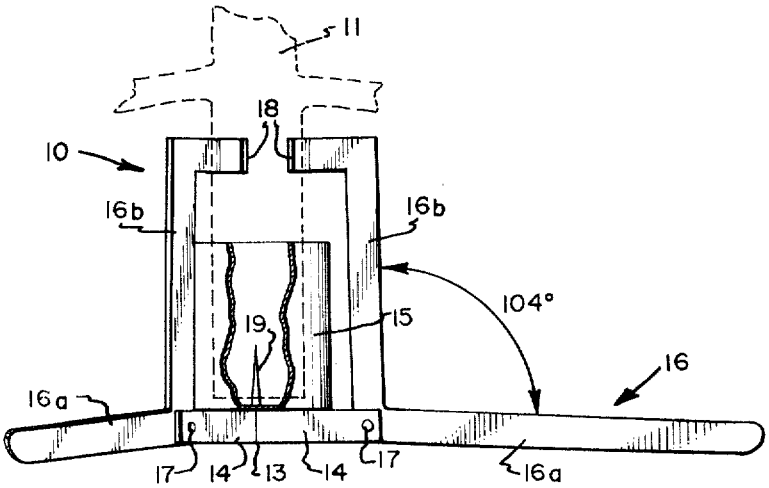

The support stand, as best shown in FIGS. 2 and 3, includes a generally Y-shaped base 13 and each leg of the Y-shaped base having an extension 14 projecting slightly outwardly beyond the side wall of an upwardly extending base vessel 15. The base vessel 15 is supported on the Y-shaped base 12 and is adapted to receive the trunk of a Christmas tree or the like.

A support member, shown generally at 16 is pivotally connected to each extension 14.

Each support member includes an outwardly extending leg portion **16*a* and an upwardly and inwardly extending arm 16*b*. The leg 16*a* and and the arm 16*b* are formed integral and a hole is provided at the intersection thereof whereby a pivot pin 17 can be inserted through the hole and through a corresponding hole in the extension 14 to properly position the support member. A partial collar 18 is fixed to and extends transversely of the inwardly extending portion of the arm 16*b*. The partial collar 18 is preferably of arcuate configuration so that it will substantially engage a circular tree trunk of a tree supported by the tree stand. The length of the upwardly extending portion of arm 16*b* is necessarily such that the inwardly extending portion and the partial collar thereon are well above the top edge of the vessel 15 so that the tree will be stabilized far enough up its trunk to effectively prevent tipping. Each leg portion 16*a* is approximately 2¼ times the length of the extensions 14, as measured from the center of the Y-shaped support and the lengths of the upwardly extending portion and height of vessel 15 are respectively about 2 1/10 and 1 1/10 times the length of the extensions. It has been found that these ratios, although variable slightly are necessary to insure proper stability of the tree on which the stand is mounted. The outer ends of the leg portion 16*a* are preferably rounded so that the support stand will be stable for every size tree trunk that is fitted within the vessel 15. It has been found that the exterior angle formed between the leg portion 16*a* and the arm portion 16*b*, when the support member is pivotally connected to the extension 15**, is between 102°–106° in order to obtain the desired low radiating profile and slim silhouette.

A spike 19 is preferably provided in the bottom of vessel 15 to project upwardly therefrom and into a tree trunk that is inserted into the vessel.

In use, the trunk of a Christmas tree, or the like, is inserted into vessel 15 and the spike is driven into the bottom of the tree trunk. Thereafter, to support the tree it is only necessary to set the tree and support stand down on the support members 16 which will pivot the inwardly projecting portions of the arm **16*b* until the partial collars engage the tree trunk, whereupon the weight of the tree on the stand exerts an inward pressure on the arms 16*b*, effectively clamping the tree within the stand. The arms 16*b* are pulled in tightly to the tree trunk to make a slim profile and the leg portions 16***a* are low to the ground or floor to present a desired low silhouette.

With the present invention there is provided a support stand for Christmas trees and the like that has a minimum of parts and that is easily constructed. In addition, the tree stand is very easily installed on the bottom of a tree and it will become apparent that the vessel 15 can be filled with water to help preserve the freshness of the tree for a maximum period of time.

Although a preferred form of my invention has been herein disclosed, it is to be understood that the present disclosure is by way of example, and that variations are possible without departing from the subject matter of the following claims, which subject matter I regard as my invention.

I claim:

1. A support stand for Christmas trees and the like comprising a generally Y-shaped base;

an open topped support vessel having its bottom mounted on said base such that portions of said Y-shaped support member project as extensions from beneath the vessel;

a support member pivotally connected to each extension, said support members each including an outwardly projecting leg portion and an upwardly and inwardly projecting arm portion and said support members being pivotally connected to said projections at the intersection of said leg and arm members, the exterior angles between said leg portions and said arm portions being between 102-106 degrees;

a partial collar fixed to and extending transversely with respect to the inwardly projecting portion of each arm and outwardly thereof, each said collar being of generally arcuate configuration, whereby the partial collar on the inwardly projecting arm portion pivots to a position well above and spaced from the top of the support vessel;

a spike extending upwardly within the vessel from the center base thereof; and said outwardly projecting leg portion being about 1½ times the length of the extensions of the Y-shaped support member, and the upwardly extending portion of the arm and the height of the vessel being respectively about 2 1/10 and 1 1/10 times the length of the extensions.

* * * * *